US010745834B2

(12) United States Patent
Terai et al.

(10) Patent No.: US 10,745,834 B2
(45) Date of Patent: Aug. 18, 2020

(54) FOOTWEAR PROVIDED WITH KNITTED FABRIC HAVING DOUBLE STRUCTURE

(71) Applicant: SHIMA SEIKI MFG., LTD., Wakayama-Shi, Wakayama (JP)

(72) Inventors: Kenta Terai, Wakayama (JP); Masamitsu Ikenaka, Wakayama (JP)

(73) Assignee: SHIMA SEIKI MFG., LTD., Wakayama-Shi, Wakayama (JP)

( * ) Notice: Subject to any disclaimer, the term of this patent is extended or adjusted under 35 U.S.C. 154(b) by 83 days.

(21) Appl. No.: 15/753,366

(22) PCT Filed: Jun. 16, 2016

(86) PCT No.: PCT/JP2016/067897
§ 371 (c)(1),
(2) Date: Feb. 19, 2018

(87) PCT Pub. No.: WO2017/033540
PCT Pub. Date: Mar. 2, 2017

(65) Prior Publication Data

US 2018/0235318 A1 Aug. 23, 2018

(30) Foreign Application Priority Data

Aug. 21, 2015 (JP) ..... 2015-163429

(51) Int. Cl.
*D04B 1/24* (2006.01)
*A43B 23/02* (2006.01)
(Continued)

(52) U.S. Cl.
CPC ..... *D04B 1/24* (2013.01); *A43B 1/04* (2013.01); *A43B 23/02* (2013.01); *A43B 23/024* (2013.01);
(Continued)

(58) Field of Classification Search
CPC .. D04B 1/104; D04B 1/12; D04B 1/24; A43B 23/0234; A43B 23/024; A43B 23/0265
See application file for complete search history.

(56) References Cited

U.S. PATENT DOCUMENTS 2,714,813 A * 8/1955 Hill ..... D04B 1/108 66/178 R
3,107,510 A * 10/1963 Manger ..... D04B 9/46 66/185
(Continued)

FOREIGN PATENT DOCUMENTS

JP 52-78541 U1 6/1977
JP 3055454 U 1/1999
(Continued)

OTHER PUBLICATIONS

International Search Report issued in International Patent Application No. PCT/JP2016/067897, 4 pages (Aug. 16, 2016).

*Primary Examiner* — Danny Worrell
(74) *Attorney, Agent, or Firm* — Rothwell, Figg, Ernst & Manbeck, P.C.

(57) ABSTRACT

Footwear includes an inner knitted fabric (5) and an outer knitted fabric (4) that are connected by a stitch row at a top line (6). In the footwear, wale directions of the inner knitted fabric and the outer knitted fabric are different, and/or, the outer knitted fabric is provided with a portion made of a knitted structure (50) with holes, and the inner knitted fabric arranged on the inner side of that portion is made of a knitted structure (60) whose stretchability is lower than that of another portion of the inner knitted fabric. A difference in stretchability between the vertical and horizontal directions of the footwear provided with a double layer knitted fabric is reduced, or a difference in stretchability depending on the position in the footwear is reduced.

5 Claims, 6 Drawing Sheets

(51) Int. Cl.
*D04B 1/12* (2006.01)
*A43B 1/04* (2006.01)
*D04B 1/10* (2006.01)

(52) U.S. Cl.
CPC ..... *A43B 23/025* (2013.01); *A43B 23/0235* (2013.01); *A43B 23/0255* (2013.01); *A43B 23/0275* (2013.01); *D04B 1/104* (2013.01); *D04B 1/12* (2013.01); *D10B 2403/023* (2013.01); *D10B 2501/043* (2013.01)

(56) References Cited

U.S. PATENT DOCUMENTS 3,259,915 A * 7/1966 Dison ..... A41B 11/005 2/239
3,626,724 A * 12/1971 Wignall et al. ..... D04B 1/108 66/14
4,047,401 A * 9/1977 Nurk ..... D04B 1/26 66/187
4,057,981 A * 11/1977 Runac ..... D04B 1/26 66/185
4,341,096 A * 7/1982 Safrit ..... A41B 11/005 66/185
4,373,215 A * 2/1983 Guigley ..... A41B 11/005 2/239
4,467,626 A * 8/1984 Coble ..... A41B 11/005 66/178 R
4,571,960 A * 2/1986 Hursh ..... A41B 11/005 66/178 R
4,615,188 A * 10/1986 Hursh ..... A41B 11/005 66/178 R
4,838,045 A * 6/1989 Cournoyer ..... D04B 1/104 66/196
4,843,844 A * 7/1989 Hursh ..... A41B 11/005 66/196
5,226,194 A * 7/1993 Staley ..... A41B 11/005 66/178 R
5,675,992 A * 10/1997 Wrightenberry ..... A41B 11/005 66/171
5,724,836 A * 3/1998 Green ..... A41B 11/00 66/185
5,778,702 A * 7/1998 Wrightenberry ..... A43B 1/04 12/142 G
6,612,136 B2 * 9/2003 Roe ..... D04B 1/26 2/239
6,931,762 B1 * 8/2005 Dua ..... A43B 1/04 12/142 G
7,587,915 B2 * 9/2009 Kaneda ..... D04B 1/26 2/239
8,973,411 B2 * 3/2015 Gaither ..... A61F 13/08 66/182
9,439,475 B2 9/2016 Ikenaka
9,675,134 B2 6/2017 Kosui et al.
10,316,441 B2 * 6/2019 Ly ..... A43B 1/04
2012/0266362 A1 * 10/2012 Craig ..... D04B 1/26 2/239
2014/0352173 A1 * 12/2014 Bell ..... A43B 1/00 36/50.1
2018/0235318 A1 * 8/2018 Terai ..... A43B 23/02

FOREIGN PATENT DOCUMENTS

WO 2013/108506 A1 7/2013
WO 2014/203585 A1 12/2014

* cited by examiner

50

60

FOOTWEAR PROVIDED WITH KNITTED FABRIC HAVING DOUBLE STRUCTURE

CROSS-REFERENCE TO RELATED APPLICATION

This application is a 35 U.S.C. 371 National Phase Entry Application from PCT/JP2016/067897, filed Jun. 16, 2016, which claims the benefit under 35 U.S.C. § 119(a) of the filing date of Japanese patent application No. 2015-163429, filed Aug. 21, 2015, the respective disclosures which are incorporated herein by reference.

TECHNICAL FIELD

The present invention relates to footwear provided with a double layer knitted fabric, and relates, for example, to a shoe upper.

Background Art

The applicant has proposed shoe uppers made of a two-layered knitted fabric comprising an inner layer and an outer layer (Patent Literature 1: WO2013/108506A and Patent Literature 2: WO2014/203585A). In these shoe uppers, a tubular inner knitted fabric and a tubular outer knitted fabric are connected at the top line, and the inner knitted fabric is inserted into the outer knitted fabric to form the two-layered shoe uppers. When the outer knitted fabric includes thermo-welding yarn, then, the inner knitted fabric and the outer knitted fabric may be bonded together.

Knitted fabrics have the wale directions and the course directions and generally, they are more likely to stretch in the course directions than in the wale directions. Meanwhile, in the shoe uppers of Patent Literatures 1 and 2, the wale directions of the inner knitted fabric and the outer knitted fabric are the same. Accordingly, the shoe uppers have anisotropic stretchability, and when a wearer wears the shoe uppers and a force is applied thereto, the shoe uppers are easily stretched in one direction but not easily stretched in another direction, and the foot comfort and the support function of a firmly standing foot is badly affected, for example.

In addition, double layer knitted fabrics have low air permeability, and thus, the provision of an air permeable structure to the shoe uppers, such as a mesh structure, may be helpful. However, the structure such as the mesh structure is likely to stretch than other knit structures, and thus the shoe uppers have different stretchabilities at the positions thereof. This may further affect foot comfort and the foot support function of a firmly standing foot, for example.

CITATION LIST

Patent Literatures

Patent Literature 1: WO2013/108506A
Patent Literature 2: WO2014/203585A

SUMMARY OF THE INVENTION

Problems to be Solved by the Invention

The object of the present invention is to reduce the difference in stretchability in footwear with a double layer knitted fabric between vertical and horizontal directions or among the positions in the footwear.

Means for Solving Problem

Footwear, according to the present invention, is provided with a double layer knitted fabric comprising the inner knitted fabric and the outer knitted fabric connected by a stitch row at the top line.

The footwear is characterized in that wale directions of the inner knitted fabric and the outer knitted fabric are different, and/or that the outer knitted fabric includes a portion made of a knitted structure with holes and that the inner knitted fabric has a knitted structure at the inner side of said portion with reduced stretchability than other portions of the inner knitted fabric.

When the inner knitted fabric and the outer knitted fabric having different wale directions are overlapped, then, the stretchability of the footwear becomes more uniform, and the footwear does not stretch in a specific direction when worn by a wearer and a force is applied thereto. Accordingly, foot comfort is improved, the footwear does not excessively deform when a force is applied, and the wearability increases. Furthermore, while the provision of a knitted structure with openings improves the air permeability for example, then the knitted fabric may easily stretch. Therefore, a knitted structure having lower stretchability than other portions is provided at a position facing the air permeable structure, and uniform stretchability in the footwear irrespective of positions is resultant. In both cases, the stretchability of the footwear becomes more uniform. Note that "the inner knitted fabric and the outer knitted fabric are connected by a stitch row" means, for example, connecting the two knitted fabrics by a stitch row belonging to both the inner knitted fabric and the outer knitted fabric, or connecting both stitch rows of the inner knitted fabric and the outer knitted fabric at the boundary by the association between the stitches in the stitch rows. Furthermore, "stitch row" means stitches arranged in a row in the knitted fabric and is not limited to a row of stitches knitted in one course.

Preferably, the wale direction of one of the inner knitted fabric and the outer knitted fabric is parallel to the direction connecting the toe and the heel, and the wale direction of the other one is parallel to the direction connecting the top line and the bottom, and the inner knitted fabric and the outer knitted fabric are connected by the stitch row at the top line and the wale directions of the fabrics cross mutually. The wale directions of the inner knitted fabric and the outer knitted fabric are different, and the inner knitted fabric and the outer knitted fabric are seamlessly connected at the top line.

Preferably, the wale directions of the inner knitted fabric and the outer knitted fabric are different, and the outer knitted fabric includes the portion made of the knitted structure with holes, and the inner knitted fabric has the knitted structure at the inner side of the portion with the reduced stretchability than other portions of the inner knitted fabric. With this configuration, the footwear does not stretch in a specific direction but stretches uniformly when worn by a wearer, and the stretchability of the footwear is uniform irrespective of the positions.

Preferably, the inner knitted fabric or the outer knitted fabric is provided with an opening suitable for inserting a coating device for applying an adhesive agent. A nozzle, a roller, or the like may be inserted into this opening to apply the adhesive agent, and the adhesive agent is applied between the outer knitted fabric and the inner knitted fabric for connecting the both fabrics in the footwear.

Preferably, at said top line, the outer knitted fabric has a plain knitted structure with face stitches and has the wale direction parallel to a periphery of the top line. The inner knitted fabric has a plain knitted structure with face stitches and has the wale direction perpendicular to the periphery of the top line. The outer knitted fabric and the inner knitted fabric curl inward of the top line. When the top line is curled inward, then the boundary portion between the inner knitted fabric and the outer knitted fabric is not conceivable.

Preferably, the outer knitted fabric is provided with the portion made of the knitted structure with holes. The inner knitted fabric is provided with, on the inner side of this portion, the portion made of the knitted structure having the lower stretchability than other portions of the inner knitted fabric. When the knitted structure with holes is provided to improve air permeability for example, then the knitted fabric may easily stretch. However, when the knitted structure having the lower stretchability than other portions is provided at the facing position, then, the footwear has more uniform stretchability irrespective of the positions.

DESCRIPTION OF EMBODIMENT

Preferred embodiments for implementing the invention will be described in the following.

Embodiments

Figure 1:
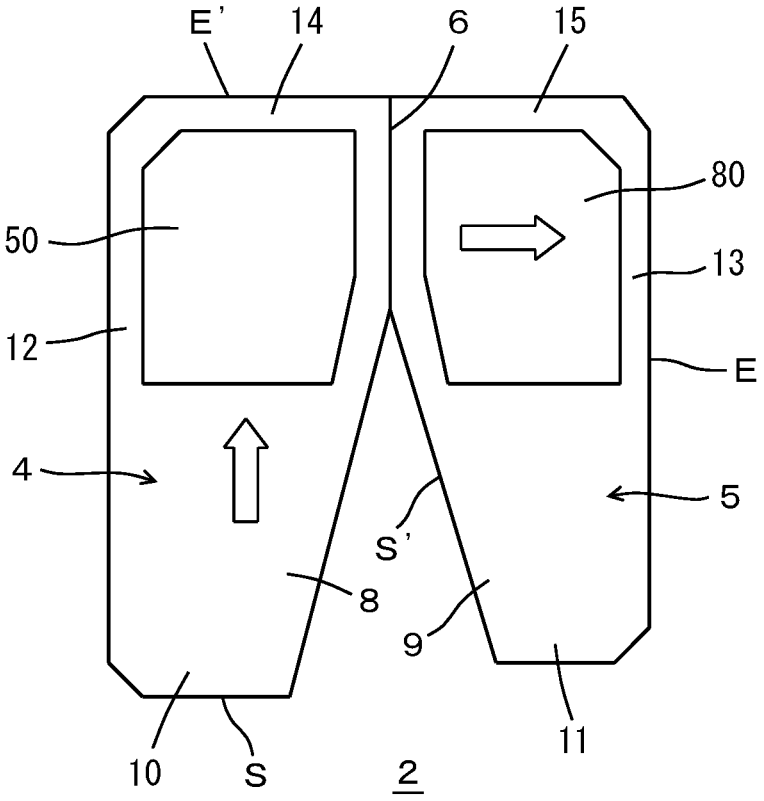
FIG. 1 is a plan view illustrating the wale directions of footwear according to a first embodiment.

FIGS. 1 to 9 show the embodiments and their modifications. They have the same configuration to the embodiments unless specifically indicated. FIG. 1 shows footwear 2 provided with a double layer knitted fabric according to an embodiment, and the numeral 4 denotes an outer knitted fabric, the numeral 5 denotes an inner knitted fabric, and they are connected together at a tubular top line 6. The knitted fabrics 4 and 5 are each tubular and are shown in a flatly arranged state. Note that both the shown sides and unshown sides of the knitted fabrics 4 and 5, for example, symmetrical. Furthermore, the inner knitted fabric 5 may be inserted into the outer knitted fabric 4 from the top line 6 so as to be overlapped with the outer knitted fabric 4 and the inner knitted fabric 5 is slightly smaller than the outer knitted fabric 4.

The outer knitted fabric 4 is provided with a cover 8, a toe 10, a bottom 12, and a heel 14, and the inner knitted fabric 5 is provided with a cover 9, a toe 11, a bottom 13, and a heel 15. Also, the outer knitted fabric 4 is provided with a knitted structure 50 with holes, and the inner knitted fabric 5 is provided with a knitted structure 80 with restricted stretchability than other portions at the position facing the knitted structure 50. The configurations of the structures 50 and 80 will be described later with reference to FIGS. 5 to 7, and the structures 50 and 80 may be arranged at any position as long as they face mutually, or may be omitted. Furthermore, the knitted structure 80 may be replaced with a knitted structure 60 in FIG. 6 or the like.

Figure 2:
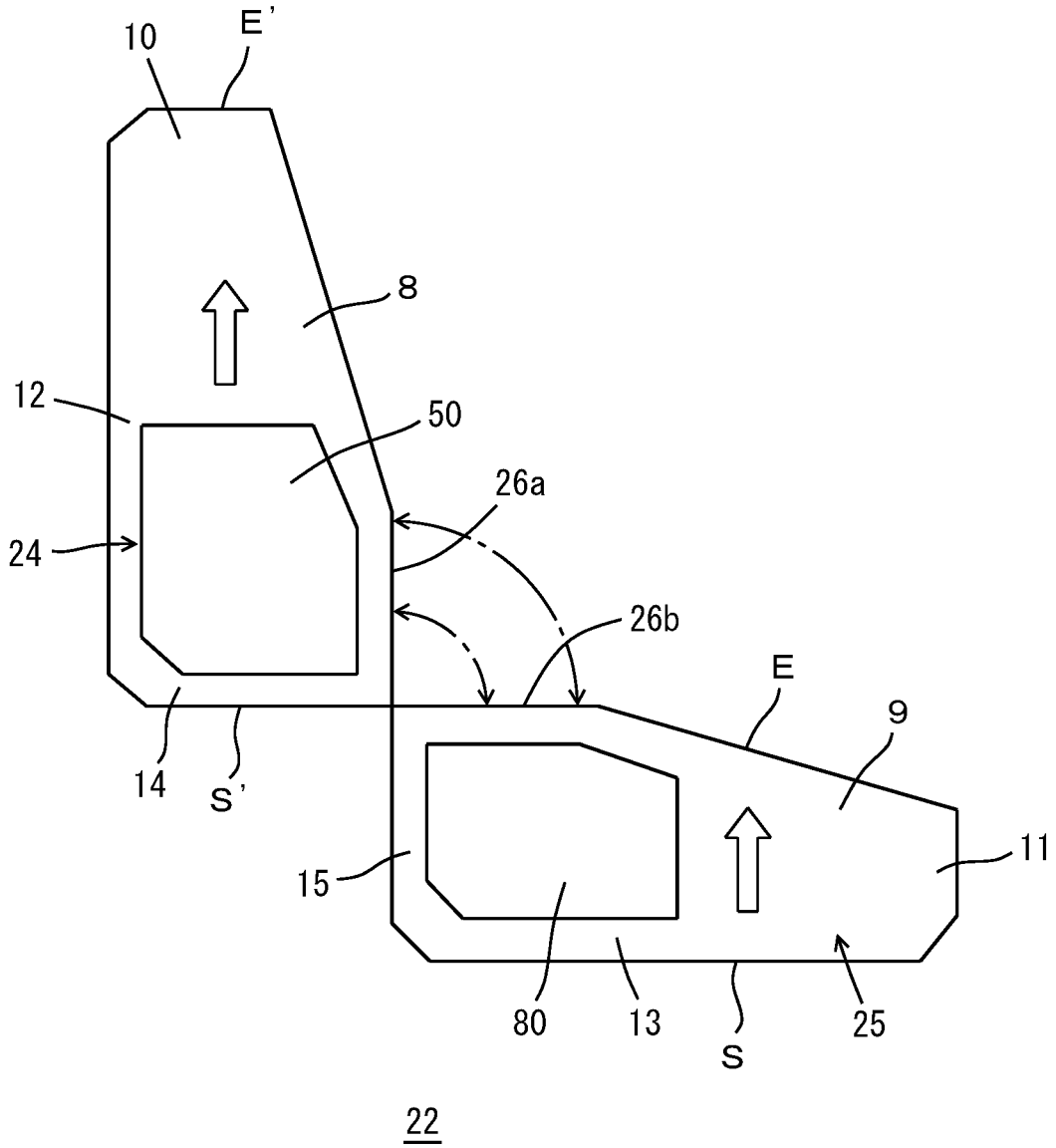
FIG. 2 is a plan view illustrating the wale directions of footwear according to a second embodiment.
Figure 3:
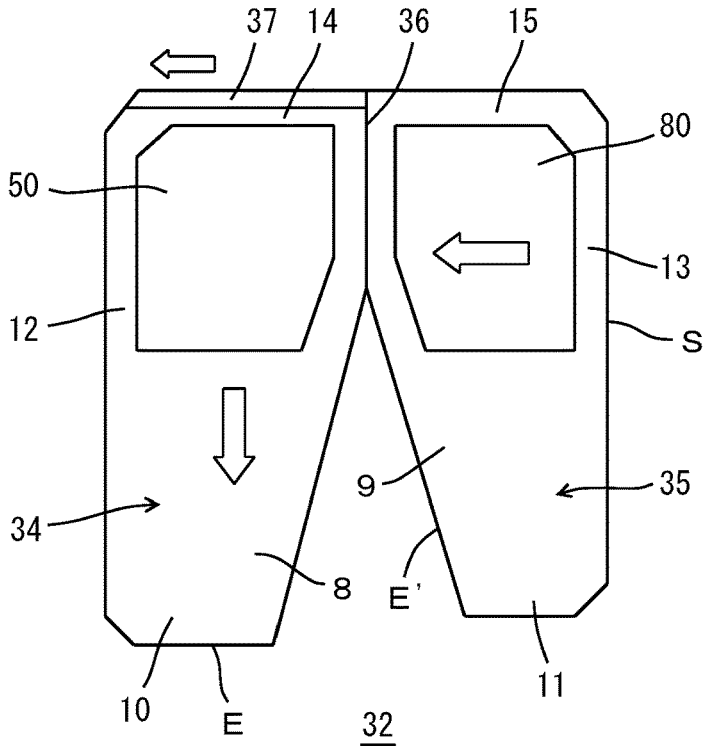
FIG. 3 is a plan view illustrating the wale directions of footwear according to a third embodiment.

In FIGS. 1 to 3, white arrows indicate the directions of wales, and knitting is performed in the direction of the arrows on a flat knitting machine with at least front and back needle beds. In the footwear 2 in FIG. 1, the outer knitted fabric 4 is knitted tubularly starting from a setup portion S at the toe 10, and the cover 8 and the like are then knitted tubularly while increasing the knitting width through widening. When the knitting reaches to the toe-side end of the top line 6, then the knitting is changed from the tubular circular knitting to C-like reciprocal knitting with an opening at the top line 6 side. The row of stitches formed by the C-like knitting is transferred by one stitch to the bottom 12 side except for the stitches at the both ends of the letter C. Then, a new C-like stitch row is knitted, and simultaneously pick up stitches are formed on the both end empty knitting needles at the top line 6 side generated by the stitch transfer. These knitting steps are repeated, and, in the resulting knitted fabric, a stitch row forming the opening of the top line 6 (a row of pick up stitches) is held on the knitting needles of the needle beds. Then, the rear end portion of the heel 14 is bound off as the ending portion E, and thereby, the outer knitted fabric 4 is completely knitted. When the knitted structure 50 is arranged in the heel 14 or the like, it is knitted during the C-like knitting, and when it is formed in the cover 8, it is knitted during the circular knitting. Furthermore, when an opening for the shoe tongue is to be formed in the cover 8, the portion including the opening is knitted by C-like knitting where the opening becomes the ends, instead of the tubular circular knitting.

The stitch row comprising the opening of the top line 6 (a stitch row in the outer knitted fabric) is held on the needles of the needle beds. A new setup portion S' is formed in the cover 9, and, with a knitting width including the setup portion S' and the stitch row of the top line 6, the inner knitted fabric 5 is set up, from the left to the right in FIG. 1, namely, in a perpendicular direction to the periphery of the top line 6, along the wale direction indicated by a white arrow. The inner knitted fabric 5 is knitted tubularly, and its course direction passes through the heel 15 and the toe 11. Then, the knitted structure 80 with restricted stretchability or the like is knitted, at an ending portion E of the bottom 13, the stitches are bound off, and the knitting is complete. According to the above knitting of the footwear 2, the outer knitted fabric 4 has the wale direction parallel to both the longitudinal direction of the footwear 2 and the periphery of the top line 6. Furthermore, the inner knitted fabric 5 has the wale direction parallel to the height direction of the footwear 2 worn by a wearer and perpendicular to the periphery of the top line 6.

When the wale directions of the inner knitted fabric 5 and the outer knitted fabric 4 are different, the stretchability of the footwear 2 becomes more uniform irrespective of the directions of forces applied, and when the wale directions cross perpendicularly, the stretchability becomes almost completely uniform. Therefore, the footwear 2 does not stretch in a specific direction, and as a result, its durability improves. Furthermore, when the wale direction of the outer knitted fabric 4 is parallel to the periphery of the top line 6, when the wale direction of the inner knitted fabric 5 is perpendicular to the periphery of the top line 6, and when both the outer knitted fabric 4 and the inner knitted fabric 5 comprise mainly plain knitted structures with face stitches at the top line 6, the top line 6 will curl inward of the opening, when the inner knitted fabric 5 is overlayed at the inner side of the outer knitted fabric 4. Accordingly, the boundary between the outer knitted fabric 4 and the inner knitted fabric 5 is hidden. Furthermore, the footwear may be knitted from the toe 11 of the inner knitted fabric 5 toward the bottom 12 of the outer knitted fabric 4. In this case, the top line 6 curls outward.

Similar footwear may be knitted in different procedures from that in FIG. 1. The footwear 22 and 32 in FIGS. 2 and 3 show such examples, where the same numerals as those in FIG. 1 denote the same elements. In the footwear 22 in FIG. 2, the inner knitted fabric 25 is tubularly knitted from the centerline along the longitudinal direction of the bottom 13 as the setup portion S. Then, the cover 9 is tubularly knitted, while the knitting width is gradually decreased, till the end of the cover 9 where the stitches of the cover 9 are bound off as the knit end portion E and the stitch row of the top line 26*b* of the inner knitted fabric 25 is held on the needles of the needle beds of the flat knitting machine. As a result, the wale direction of the inner knitted fabric 25 becomes perpendicular to the periphery of the top line 26*b*. Subsequently, a setup portion S' is formed at the rear end of the heel 15, and the outer knitted fabric 24 is knitted from the heel 14 toward the toe 10 in a wale direction parallel to the longitudinal direction of the footwear 22. During this, the top line 26*a* of the outer knitted fabric 24 and the top line 26*b* of the inner knitted fabric 25 are connected together, while repeating the following knitting process where stitches of the top line 26*a* are overlapped with the stitches of the top line 26*b*, and new stitches are formed and connected to the double stitches. When the top lines 26*a* and 26*b* are connected, a stitch row comprising the double stitches between the inner knitted fabric 25 and the stitches of the outer knitted fabric 24 is obtained. Then, the knitting width is gradually decreased with narrowing process in the cover 8, and the stitches of toe 10 are bound off as the ending portion E'. During these knitting steps, mutually facing knitted structures 50 and 80 are knitted similarly as the footwear 2. Furthermore, the wale directions of the inner knitted fabric 25 and the outer knitted fabric 24 are mutually perpendicular. Around the top line 26, the wale direction of the outer knitted fabric 24 is parallel to the periphery of the top line, that of the inner knitted fabric 25 is perpendicular to the periphery of the top line, and the knitted structure is a plain with face stitches. Accordingly, when the inner knitted fabric 25 is inserted inside the outer knitted fabric 24, the top line 26 curls inward. Furthermore, the footwear may be knitted from the bottom 12 of the outer knitted fabric 24 till the toe 11 of the inner knitted fabric 25. In this case, the top line 26 curls outward.

In the footwear 32 in FIG. 3, the inner knitted fabric 35 is knitted tubularly, from the centerline of the bottom 13 along the longitudinal direction as the setup portion S, including the heel 15 and the toe 11. The tubular knitting is continued, while the knitting width is gradually decreased in the cover 9, the stitch row at the end of the cover 9 is bound off as the ending portion E', and the stitch row at the inner knitted fabric 35 side tip of the top line 36 is held on the needles of the needle beds of the flat knitting machine. During these steps, the knitted structure 80 with restricted stretchability or the like is knitted.

The stitch row at the top line 36 is held tubularly on the needle beds of the flat knitting machine. While holding the stitch row of the top line 36 on the needles, a band-shaped portion 37 extending in the height direction of the heel 14 of the outer knitted fabric 34 is knitted after knitting a stitch row at the heel 15 side end of the top line 36. The wale direction of the portion 37 is in the direction from the top line 36 to the bottom 12. The knitting of the portion 37 is C-like knitting folding back at the heel 14 side of the top line 36. The row of stitches formed in the C-like knitting are outwardly transferred by one stitch along the knitting width on the needle beds, except for the stitches at both ends of the letter C. Pick up stitches are formed on the empty needles due to the stitch transfer, and a new C-like stitch row is knitted with the pick up stitches being located at the both ends. When these knitting steps are repeated till the tip of the portion 37 and till the stitches at the tip are bound off, then, the both side end stitch rows of the portion 37 (pick up stitch rows) are parallelly held on the needles of the needle beds. The needle beds hold the stitch rows of the portion 37 and the stitch row of the top line 36 other than the stitches in the portion 37. As shown in FIG. 3, from the stitch rows of the portion 37, knitting is performed toward the toe 10. During this, new stitches are formed and connected to the stitches of the top line 36 and the inner knitted fabric 35 and the outer knitted fabric 34 are connected at the top line 36. Furthermore, during the above knitting, the knitted structure 50 is formed at a position facing the knitted structure 80. Then, while decreasing the knitting width with narrowing in the cover 8, the footwear is knitted to the toe 10 as the ending portion E and is bound off, and thereby the footwear 32 is obtained.

Also in the case in FIG. 3, around the top line 36, the wale direction of the outer knitted fabric 34 is parallel to the periphery of the top line 36, except for the portion 37, the wale direction of the inner knitted fabric 35 is perpendicular to the periphery of the top line 36, and the top line 36 is made of a plain knitted structure with face stitches. Accordingly, when the inner knitted fabric 35 is inserted into the outer knitted fabric 34, the top line 36 curls inward. Since the wale directions of the inner knitted fabric 35 and the outer knitted fabric 34 are perpendicular except for the portion 37, the stretchability of the footwear 32 is uniform irrespective of the force direction.

Regarding the footwear 2, 22, and 32, the inner knitted fabrics 5, 25, and 35 are inserted into the outer knitted fabrics 4, 24, and 34, from the top lines 6, 26*a*, 26*b*, and 36 and are overlapped with the outer knitted fabrics 4, 24, and 34. Accordingly, the two-layered footwear 2, 22, and 32 are obtained. To bond the inner knitted fabrics 5, 25, and 35 and the outer knitted fabrics 4, 24, and 34, a thermo-welding fiber is included in the knitting yarn for the outer knitted fabrics 4, 24, and 34, for example, and thermal treatment is performed for adhering them after the knitting. When the thermo-welding fiber melts, the textures of the outer knitted fabrics 4, 24, and 34 change. Accordingly, preferably, an adhesive agent is applied with a splay, a roller, or the like between the inner knitted fabrics 5, 25, and 35 and the outer knitted fabrics 4, 24, and 34. The agent is applied to inner surfaces of the tubular knitted fabrics which are not shown in FIGS. 1 to 3.

Figure 4:
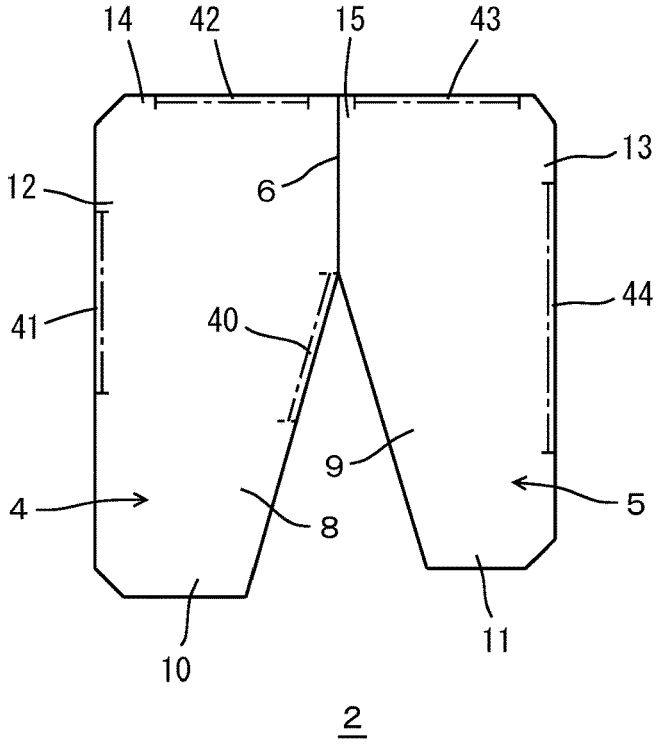
FIG. 4 is a plan view of the footwear of the embodiments illustrating openings for applying an adhesive agent.

While openings 40 to 44 for applying the adhesive agent are shown in FIG. 4, one of the openings is sufficient. A nozzle, a roller, or the like for applying the adhesive agent may be inserted from the openings 40 to 44 between the inner knitted fabric 5 and the outer knitted fabric 4. By the way, in FIG. 4 the footwear 2 is illustrated as an example, but the same applies to the footwear 22 and 32. The opening 40 is an example of an opening for an outer knitted fabric 4 provided with a shoe tongue. If there is no such opening, then one of the openings 41 to 44 is formed in the bottoms 12 and 13, the heels 14 and 15, or the like, and a nozzle, a roller, or the like is inserted. The openings 41 to 44 are closed later for example, or are bonded to a sole, a heel counter, or the like, for closing the openings. In doing so, the openings 41 to 44 may be provided without affecting neither the design nor strength of the footwear 2.

Figure 5:
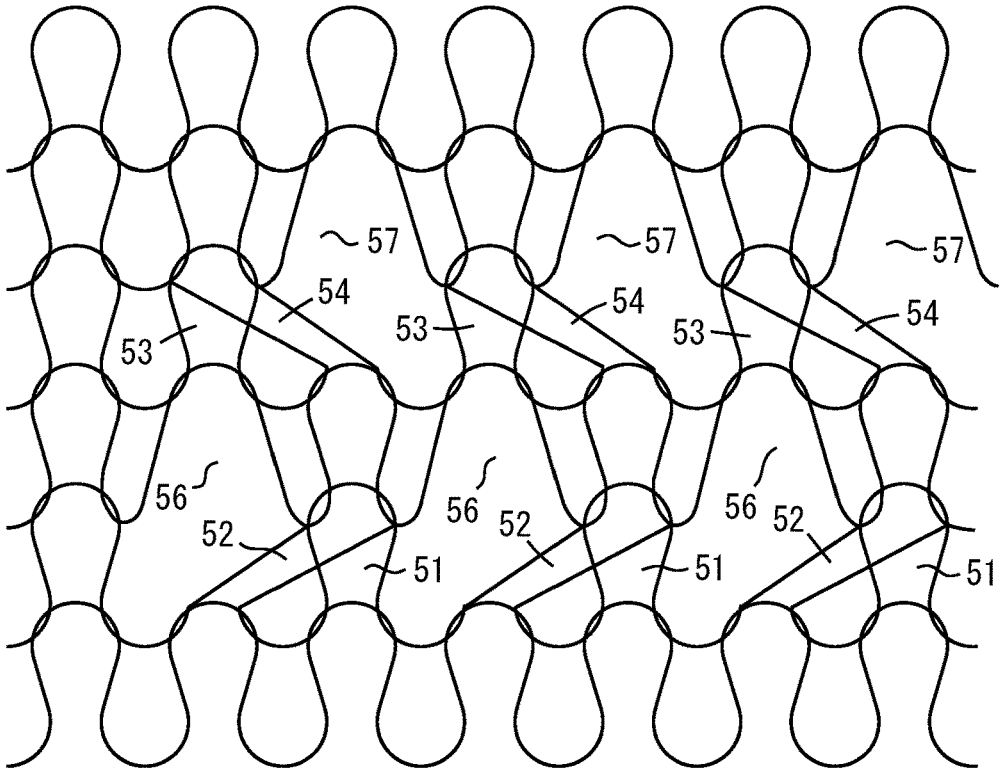
FIG. 5 is a diagram illustrating an example of a knitted structure with holes.

FIG. 5 shows an example of the knitted structure 50 with holes made by a mesh structure. Stitches 51 and 52 are overlapped to form a hole 56, and stitches 53 and 54 are overlapped to form a hole 57. The knitted structure 50 is more stretchable and more permeable than the knitted structures 60 and 80 with restricted stretchability in FIGS. 6 and 7. Accordingly, it is preferable to use the knitted structure 50 for the outer knitted fabrics 4, 24, and 34, and to use the knitted structures 60 and 80 for the inner knitted fabrics 5, 25, and 35.

Figure 6:
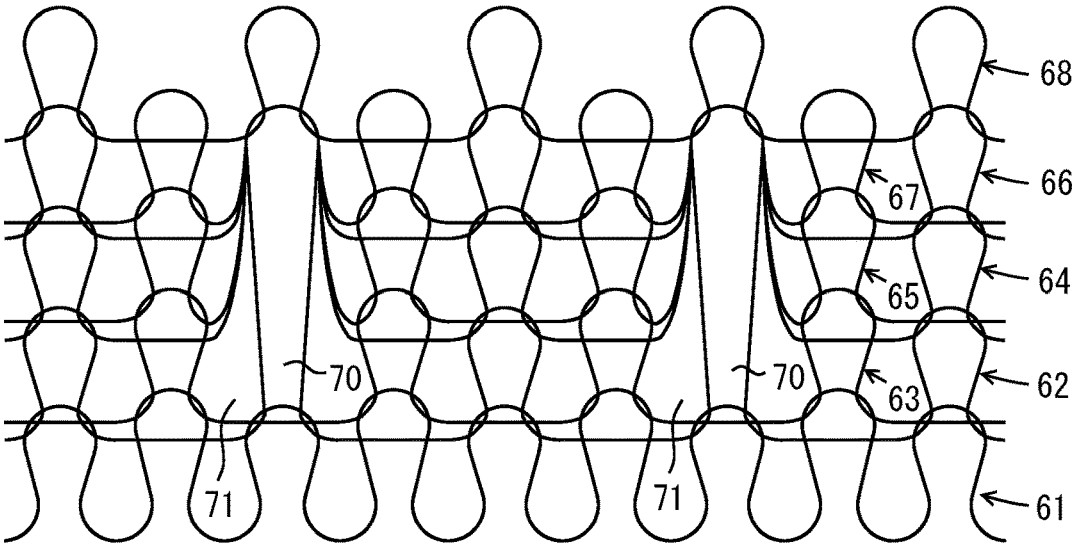
FIG. 6 is a diagram illustrating an example of a knitted structure with holes and restricted stretchability.

FIG. 6 shows a permeable knitted structure 60 with restricted stretchability, and the knitted structure 60 is knitted in combination of tuck knitting and smooth knitting. Footwear with the double layer knitted fabric has low permeability, and it is preferable for the outer knitted fabrics 4, 24, and 34 to have a portion of a permeable knitted structure. Furthermore, according to a design choice, the outer knitted fabrics 4, 24, and 34 may have a portion made of a knitted structure with holes so that the inner knitted fabrics 5, 25, and 35 are exposed and viewed. The numerals 61 to 68 denote stitch rows, the numeral 70 denotes stitches in every two of the stitch row 62 upon which multiple tucking are performed, and the numeral 71 denotes holes formed in the vicinity of the stitch 70. In smooth knitting, the stitch row of one course is formed by two mutually overlapping stitch rows, and in FIG. 6, the stitch rows 62 and 63 are mutually overlapped to form one stitch row of one course, similarly, the stitch rows 64 and 65 are overlapped, and the stitch rows 66 and 67 are overlapped. The stitches 70 of the stitch row 62 are tucked multiple times, for example, four times during knitting the stitch rows 64 to 67, and subsequently, new stitches are formed on them when the stitch row 68 is knitted. Then, the stitches 70 are drawn upward in FIG. 6, and the holes 71 are formed.

Due to the smooth knitting, the knitted structure 60 is unlikely to stretch in the left/right direction in FIG. 6. This is due to the long prolongations (miss stitches) that are unlikely to stretch without the bend between stitches. Since the stitches 70 are tucked multiple times, the stitches 70 are stretched in the up/down direction in FIG. 6, and thus the knitted structure 60 is unlikely to stretch in the up/down direction in FIG. 6. Accordingly, the knitted structure 60 is unlikely to stretch in both the course direction (left/right direction in FIG. 6) and the wale direction (up/down direction in FIG. 6) and has excellent permeability because of the holes 71.

Figure 7:
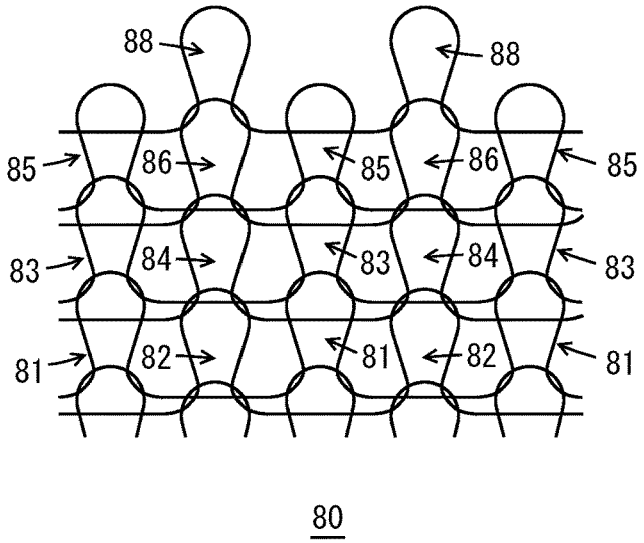
FIG. 7 is a diagram illustrating an example of a knitted structure with restricted stretchability.

FIG. 7 shows an example of the knitted structure 80 with restricted stretchability. The knitted structure 80 is knitted by smooth knitting, where stitch rows 81 and 82 overlap mutually, stitch rows 83 and 84 overlap mutually, and stitch rows 85 and 86 overlap mutually. Generally, in the wale direction, knitted fabrics are unlikely to stretch. Furthermore, since the smooth knitting includes many miss stitches, there are less yarn for stretching, and the stretchability is restricted in both the wale direction and the course direction. Accordingly, the knitted structure 80 is difficult to stretch in both the course direction and the wale direction. The knitted structures 80 are arranged in the inner knitted fabrics 5, 25, and 35 so as to face the knitted structures 50. While the knitted structure 50 has holes and thus may easily stretch, however, the stretchability by the knitted structure 50 is cancelled by the knitted structure 80, and the stretchability of the footwear 2, 22, and 32 is uniform irrespective of its position. Note that in place of the knitted structure 80, the knitted structure 60 may be used.

Figure 8:
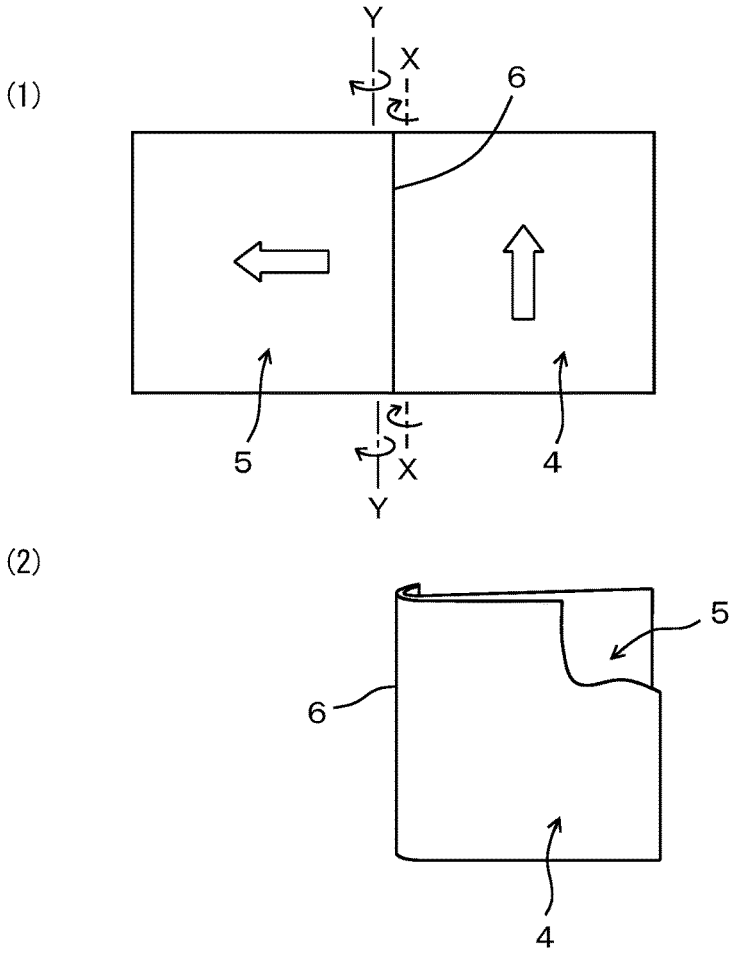
FIG. 8 is a diagram illustrating the mechanism how the top line is curled inward: (1) shows curl directions of the individual knitted fabrics; and (2) shows a curl direction after joined together.

FIG. 8 shows portions in the vicinity of the top line 6, reversed in the left/right direction, and extracted from the footwear comprising the knitted fabrics in FIG. 1 and illustrates the curl mechanism of the top line 6 and the like. Plain knitted structures have the characteristic that the face-stitch surface tends to curl toward the purl-stitch surface at the course direction edges of the knitted fabric (left and right edges), and the purl-stitch surface tends to curl toward the face-stitch surface at the wale direction edges of the knitted fabric (upper and lower edges). In FIG. 8(1), the face-stitch surfaces of the outer knitted fabric 4 and the inner knitted fabric 5 are shown. White arrows indicate the wale directions, and at the top line 6, the edge in the course direction of the outer knitted fabric 4 and the edge in the wale direction of the inner knitted fabric 5 are knitted together. Therefore, the edge of the outer knitted fabric 4 tends to curl clockwise with respect to the X-X axis of the drawing when seen from above the drawing, and the edge of the inner knitted fabric 5 tends to curl clockwise with respect to the Y-Y axis of the drawing. As shown in FIG. 8(2), when these knitted fabrics are overlapped where the outer knitted fabric 4 is located outside, then the knitted fabrics curl inward of the top line 6.

By the way, before the inner and outer knitted fabrics overlap each other as shown in FIGS. 1 to 4, the outer knitted fabrics 4, 24, and 34 curl inward of the top lines 6, 26, and 36, and the inner knitted fabrics 5, 25, and 35 curl outward of the top lines 6, 26, and 36. When inserted into the outer knitted fabrics 4, 24, and 34, the inner knitted fabrics 5, 25, and 35 are reversed with respect to their face and back, the direction of the curl is also reversed, and thus, they curl inward of the top lines 6, 26, and 36.

Figure 9:
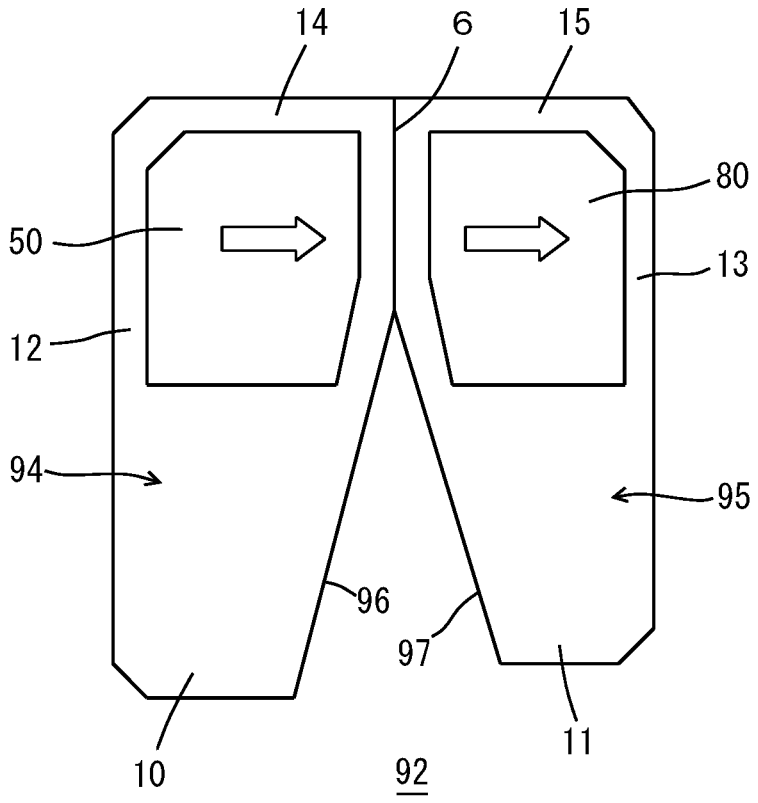
FIG. 9 is a plan view illustrating footwear according to a fourth embodiment.

FIG. 9 shows footwear 92 where the outer knitted fabric 94, with the knitted structure 50 with holes, and the inner knitted fabric 95, with the knitted structure 80 with restricted stretchability, are overlapped. The difference from the footwear 2, 22, and 32 of FIGS. 1 to 3 is in that the wale directions of the outer knitted fabric 94 and the inner knitted fabric 95 are the same. For example, the outer knitted fabric 94 is tubularly knitted from the bottom 12 till the tubular top line 6 along the white arrow in the drawing and is bound off at the centerline 96 of the cover along the longitudinal direction. The tubular inner knitted fabric 95 is knitted from the top line 6 and also from the centerline 97 of the cover along the longitudinal direction for increasing the knitting width of the tubular knitted fabric, and the knitting ends at the bottom 13. The knitting may also start from the bottom 13 of the inner knitted fabric 95 and may end at the bottom 12 of the outer knitted fabric 94. Furthermore, the knitting may also start from the toes 10 and 11 and may end at the heels 14 and 15, or conversely, the knitting may also start from the heels 14 and 15 and may end at the knitting at the toes 10 and 11.

The embodiments show the footwear 2, 22, 32, and 92 for shoe uppers, but the footwear may also serve as a slipper, a sandal, a sock, or the like.

DESCRIPTION OF REFERENCE NUMERALS

2, 22, 32 footwear
4, 24, 34 Outer knitted fabric
5, 25, 35 Inner knitted fabric
6, 26, 36 top line
8, 9 Cover
10, 11 Toe
12, 13 Bottom
14, 15 Heel
37 Portion
40 to 44 Opening
50 Knitted structure with holes
51 to 54 Stitch
56, 57, 71 Holes
61 to 68 Stitch row
70 Stitch
60, 80 Knitted structure with restricted stretchability
81 to 88 Stitch row
92 footwear
94 Outer knitted fabric
95 Inner knitted fabric
96, 97 Centerline along the longitudinal direction of the cover
S, S' Setup portion
E, E' Ending portion
X, Y Axis of curl

The invention claimed is:

1. Footwear provided with a double layer knitted fabric comprising an inner knitted fabric and an outer knitted fabric connected by a stitch row at a top line, wherein wale directions of the inner knitted fabric and the outer knitted fabric are different and cross mutually, and wherein the wale direction of one of the inner knitted fabric and the outer knitted fabric is parallel to a line connecting a toe and a heel, and the wale direction of the other one is parallel to a line connecting the top line and a bottom of the footwear.

2. The footwear provided with a double layer knitted fabric according to claim 1, wherein the outer knitted fabric includes a portion made of a knitted structure with holes, and wherein the inner knitted fabric has a knitted structure at an inner side of the portion made of the knitted structure with holes with reduced stretchability than other portions of the inner knitted fabric.

3. The footwear provided with a double layer knitted fabric according to claim 1, wherein the inner knitted fabric or the outer knitted fabric is provided with an opening suitable for inserting a coating device for applying an adhesive agent between the outer knitted fabric and the inner knitted fabric.

4. The footwear provided with a double layer knitted fabric according to claim 1, wherein, at said top line, the outer knitted fabric has a plain knitted structure with face stitches and has the wale direction parallel to a periphery of the top line, wherein the inner knitted fabric has a plain knitted structure with face stitches and has the wale direction perpendicular to the periphery of the top line, and wherein the outer knitted fabric and the inner knitted fabric cud inward of the top line.

5. The footwear provided with a double layer knitted fabric according to claim 1, wherein the wale direction of the inner knitted fabric is perpendicular to the wale direction of the outer knitted fabric.

* * * * *